US005094888A

United States Patent [19]

Kamienski et al.

[11] Patent Number: 5,094,888

[45] Date of Patent: Mar. 10, 1992

[54] STRENGTHENING CELLULOSIC MATERIALS

[75] Inventors: Conrad W. Kamienski; Robert S. Wedinger, both of Gastonia, N.C.

[73] Assignee: FMC Corporation, Philadelphia, Pa.

[21] Appl. No.: 481,257

[22] Filed: Feb. 20, 1990

[51] Int. Cl.[5] ..... D21H 25/18

[52] U.S. Cl. ..... 427/296; 162/9; 162/157.6; 162/158; 162/168.1; 162/181.1; 162/181.2; 162/182; 427/391; 427/395; 427/411; 427/419.8

[58] Field of Search ..... 162/160, 182, 135, 136, 162/9, 157.6, 158, 168.1, 181.1, 181.2; 422/33, 34, 40; 427/296, 342, 391, 395, 411, 419.8

[56] References Cited

U.S. PATENT DOCUMENTS 3,676,055 7/1972 Smith ..... 8/120
3,969,549 7/1976 Williams et al. ..... 162/160
4,051,276 9/1977 Williams et al. ..... 162/160
4,724,158 2/1988 Mollett et al. ..... 427/44
4,808,433 2/1989 Mollett et al. ..... 427/44
4,863,566 9/1989 Warren et al. ..... 162/182

*Primary Examiner*—Shrive Beck
*Assistant Examiner*—Terry J. Owens
*Attorney, Agent, or Firm*—Charles C. Fellows; Robert L. Andersen

[57] ABSTRACT

A process for strengthening the cellulose in materials which have been treated with an alkaline organometallic compound selected from a metal alkyl, metal alkoxide or alkyl metal alkoxide to deacidify the cellulose and which cellulosic material is wet with treatment solvent, by treating the undried cellulosic material with a polar monomer and then drying the cellulose material and polymerizing the monomer by subjecting the treated cellulose to vacuum and heat.

3 Claims, No Drawings

STRENGTHENING CELLULOSIC MATERIALS

This invention relates to the treatment of books, bound volumes, and archival material which have been previously impregnated with an alkaline buffer.

Paper manufacture for many years has been based on a process in which the paper fibers are sized during manufacture by adding a mixture of alum and rosin to the wet fiber slurry before the sheet of paper was formed on a paper making machine. This coated the fibers in the paper with rosin and made the paper suitable for use in printing or for writing on. Unfortunately, alum, aluminum sulfate $(Al_2SO_4)_3$, is one of the major causes of acid in paper which results in eventual degradation of the paper when the alum is converted to sulfuric acid.

The problem of acidity in books has been recognized for quite a long time and a great deal of work has been done to establish a process for deacidifying such books. A recent report, "Mass Deacidification for Libraries" by George Martin Cunha, Adjunct Professor of Conservation, College of Library and Information Science, University of Kentucky, was printed in Library Technology Reports, Volume 23, No. 3, May–June 1987. The Cunha report claims to have reviewed all known experiments with methods of mass deacidification, and six were thoroughly investigated. One of the major methods of mass deacidification considered was the so-called diethyl zinc (DEZ) system which appears to be covered by U.S. Pat. Nos. 3,969,459 and 4,051,276 assigned to the United States of America as represented by the Librarian of Congress. Mass deacidification with diethyl zinc is a 50–55 hour three-phase process consisting of preconditioning, permeation and passivation. The DEZ system under development by the Library of Congress will handle thousands of books per cycle. However, liquid diethyl zinc is pyrophoric (will spontaneously ignite when exposed to air) and will react explosively with water. The fire and explosive hazards of diethyl zinc make it a dangerous chemical to work with and probably one that every library could not contemplate using. Moreover, the fire and explosive hazards have caused considerable expensive design problems in developing suitable equipment for this process.

Another major method of mass deacidification evaluated in the Cunha report was one employing methoxymagnesium methylcarbonate in a solution of alcohol and fluorocarbons in treating books en masse. The system is a liquid process designed to dissolve, transport and deposit the chemicals into book pages to neutralize acids present in the paper and to deposit buffering chemicals that will neutralize any acids that may subsequently contaminate the paper. This system appears to be covered by U.S. Pat. No. 4,318,963 of Richard D. Smith and U.S. Pat. No. 3,939,091 of George B. Kelly (assigned to the United States of America as represented by the Librarian of Congress) and is based on earlier U.S. Pat. Nos. 3,676,055 and 3,676,182 to Richard D. Smith. The process employs methoxymagnesiummethyl carbonate dissolved in a liquid solution of fluorocarbons and methyl alcohol. This alcohol is necessary to promote solution of the magnesium compound. This solution reacts with water in the paper to form magnesium carbonate, magnesium hydroxide and magnesium oxide, some of which react with the acid in the paper to form neutralized salts. The remaining mixture of carbonate, hydroxide and oxide remains in the paper as basic magnesium carbonate which forms an alkaline reserve or buffering agent that will neutralize future acid contamination of the paper. Disadvantages of the process include feathering of alcohol-soluble inks and colors and attack on some highly nitrated book covers, and thus a presorting by uses is required.

According to the Cunha report, ammonia has been used in India for mass deacidification of books. Langwell in England used cyclohexylamine carbonate, while in the United States the Barrow Laboratory in Virginia conceived the use of morpholine (U.S. Pat. No. 3,771,958). The morpholine, ammonia and cyclohexylamine carbonate systems were moderately effective deacidifiers, but did not provide a buffer in the paper to provide protection of the paper from post-treatment acid attack. A patent to R.A. Kundrot (U.S. Pat. No. 4,522,843) claims a method of deacidifying books using alkaline particles of a basic metal suspended in an aerosol.

Another approach to retard degradation and restore the strength of paper is achieved by impregnating the paper with a vinyl monomer and converting the monomer to a polymer in situ by means of high energy radiation. The one such process is described in detail in U.S. Pat. No. 4,724,158, issued Feb. 9, 1988, to Christopher C. Mollett et al. This patent also contains a list of other processes involving the polymerization treatments on cellulose.

The present invention provides a process for the treatment of books, bound materials and other archival material; which materials have been previously deacidified with an organometallic compound in a solvent and which upon removal of excess solvent leave within the treated cellulose materials a preservative amount of an alkaline buffer, by further treatment with at least one polar monomer. The treated cellulosic material is processed to remove excess solvent, but the cellulosic material is not dried prior to the time it is treated with one or more polar monomers. The organometallic compounds within the cellulose can polymerize the monomers, for example, within the pages of a book, to deposit a paper strengthening matrix therein. Optionally the buffer may also contain a catalyst which may or may not be a buffer, and/or an oxygen scavenger deposited with the buffer material during the deacidification stage. Once the monomer treatment is complete the treated materials are heated under vacuum to remove the residual solvent. The heating and solvent removal step may assist in the polymerization of monomer.

Metal alkyls, such as n-butyllithium, dibutylmagnesium, and diethylzinc can be used to deacidify books and to provide a preservative alkaline buffer within the pages of the book. Similarly, metal alkoxides such as sodium and lithium t butoxide, sodium and lithium butoxytriglycoxide and magnesium bis(butoxytriglycoxide) their carbonated derivatives, such as methoxymagnesium methyl carbonate, as well as mixed alkyl metal alkoxides, such as butylmagnesium (butoxytriglycoxide) and ethylzinc methoxypoly(ethyleneoxide), or mixtures of these types may be employed to preserve books.

In the present process, after acid damaged books have been treated and rinsed to remove any excess metal alkyl, metal alkoxide, carbonated metal alkoxides, or alkyl metal alkoxide, the solvent-wet books are treated with at least one polar monomer, which include but are not limited to monomers such as ethyl acrylate, methyl methacrylate, ethylene oxide, propylene oxide, acrylonitrile, methacrylonitrile, N,N'-diethylacrylamide and so forth dissolved in a halocarbon or mixture thereof with polar solvents such as tetrahydrofuran or glycol dimethylether. Following the monomer treatment, any solvent and unreacted and/or uncomplexed monomers are removed under vacuum and heating, and the books dried.

Advantages of the present process are that the polymerization treatment can take place in the same equipment as is used for the deacidification of the books. Moreover, the combination of deacidifying and strengthening by means of in situ polymerization both stop further acid degradation and strengthens the paper. Another advantage is the versatility of combining this process with the previous processes which provide an artist with either simple deacidification or the combination of deacidification with strengthening or simply strengthening of the cellulose. Still a further advantage is that there is minimal or no polymer disposition on the walls of the treatment vessel.

Suitable monomers for use in a process of the present invention are, for example, those of the general formula $$CH_2{=}CR'{-}COOR$$

in which

R' represents a hydrogen atom or a lower alkyl radical, e.g. ethyl or, preferably, methyl, and R represents a group of the general formula $$C_nH_{2n+1} \text{ or } C_nH_{2n}X$$

in which n represents an integer from 1 to 16, and

X represents an alkoxy or di-lower alkylsubstituted amino group.

It should be understood that the term "lower" used herein in connection with lower alkyl radicals represented for example by R' or in a radical represented by R denotes such groups that have from 1 to 4 carbon atoms.

The monomer component may comprise a single monomer or two or more monomers which may, if desired, be mixed prior to treatment of the substrate or added sequentially but this is not essential.

Examples of these compounds are

Acrylates:

methyl, ethyl, propyl, isopropyl, butyl, amyl, hexyl, heptyl, isobutyl, s-butyl, t-butyl, 2-methyl-1-butyl, 3-methyl-1-butyl, 3-pentyl, 2-methyl-1-pentyl, neopentyl, 2-ethyl-1-butyl, 4-methyl-2-pentyl, 2-heptyl, 2-ethyhexyl, 2-hydroxyethyl and phenyl Methacrylates:

methyl, ethyl, butyl, cyclohexyl, 2-hydroxyethyl, allyl, and 2-(dimethylamino)ethyl.

Acrylamides and methacrylamides:

dimethylamino, diethylamino, di-n-butylamino, di-t-butylamino, di-hexylamino, dimethylaminopropyl,methoxyethyl, and methoxyethoxyethyl.

Nitriles:

acrylonitrile, methacrylonitrile.

Other monomers which can be used alone or in conjunction with the above are alkylene oxides such as: ethylene oxide, propylene oxide, and butylene oxide. The following examples further illustrate the invention.

EXAMPLE 1

Sections of an old book, approximately 3 inch by 3 inch by 1 inch thick were pre-dried to less than 1% by weight water and placed in the treatment vessel under an inert gas (argon). The book sections were covered with a Freon TF solution containing five weight percent sodium butoxytriglycoxide. After 10 minutes, the treatment solution was withdrawn and the books allowed to drain for 15 minutes. The books were then rinsed with Freon TF and again allowed to drain. The undried books were then covered with a solution of ethyl acrylate monomer in Freon TF. (The monomer had been degassed, distilled under vacuum and purged with argon prior to use.) After a period of time the treatment solution was withdrawn.

The book sections were then subjected to dielectric heating and vacuum to facilitate polymerization and remove excess monomer and solvent.

EXAMPLE 2

Example 1 was repeated except that the book sections were covered with a heptane solution of diethyl zinc (the diethyl zinc may also be deposited on the book sections from the vapor phase) instead of a Freon TF solution of sodium butoxytriglycoxide. After rinsing the books with fresh heptane solvent, ethylene oxide gas was admitted to the treatment vessel for a period of time after which the vessel was purged, and then ethyl acrylate monomer was admitted to the vessel for a period of time. The vessel was again purged after which the books were dried as described in Example 1.

The dried book sections of Example 1 and Example 2 respectively contained sodium or zinc and ethyl acrylate polymer distributed through the book sections effectively deacidifying the book sections and reenforcing or strengthening the paper in the treated book pages.

This example can be repeated with other liquid monomers which should be degassed, distilled under vacuum and purged with an inert gas prior to use.

Highly volatile monomers such as methyl methacrylate are introduced to the treatment vessel as a gas and condensed in the book sections or other materials to be treated or as a solution, e.g., in FREON TF. Additional monomers to use are ethylene oxide, propylene oxide, acrylonitrile, methacrylonitrile, N,N'-diethylacrylamide and mixtures of these monomers.

What is claimed:

1. A process for strengthening the cellulose in materials which have been treated with an alkaline organometallic compound selected from a metal alkyl, metal alkoxide (or its carbonated derivative) or alkyl metal alkoxide to deacidify the cellulose and which cellulosic material is wet with treatment solvent containing said alkaline organometallic compound, comprising treating the wet cellulosic material with at least one monomer and then drying the cellulosic material and polymerizing the monomer or monomers by subjecting the treated cellulosic material to vacuum and heat.

2. The process according o claim 1 wherein the polar monomer is selected from the group consisting of ethylacrylate, methylmethacrylate, ethylene oxide, propylene oxide, acrylonitrile, methacrylonitrile, N,N'-diethylacrylamide and mixtures of these monomers.

3. The process according to claim 1 in which the alkaline organometallic compound is selected from the group consisting of sodium butoxytriglycoxide and diethyl zinc.

* * * * *